US007628139B2

(12) United States Patent
Göney et al.

(10) Patent No.: US 7,628,139 B2
(45) Date of Patent: Dec. 8, 2009

(54) FUEL INJECTOR WITH DUAL PIEZO-ELECTRIC ACTUATOR

(75) Inventors: Kayhan Halil Göney, Esslingen (DE); He Jiang, Canton, MI (US); Yury Kalish, West Bloomfield, MI (US)

(73) Assignee: Detroit Diesel Corporation, Detroit, MI (US)

( * ) Notice: Subject to any disclaimer, the term of this patent is extended or adjusted under 35 U.S.C. 154(b) by 107 days.

(21) Appl. No.: 11/484,415

(22) Filed: Jul. 11, 2006

(65) Prior Publication Data

US 2008/0011274 A1 Jan. 17, 2008

(51) Int. Cl.
*F02M 59/46* (2006.01)

(52) U.S. Cl. ..... 123/467; 239/585.1

(58) Field of Classification Search ..... 123/472, 123/531, 532, 533, 534, 446, 458, 447, 467; 60/521, 528; 239/89, 584, 585.1; 310/328; 251/129.1

See application file for complete search history.

(56) References Cited

U.S. PATENT DOCUMENTS 3,501,099 A * 3/1970 Benson ..... 239/584
4,197,997 A 4/1980 Wu et al.
4,373,671 A 2/1983 Giardini
4,899,714 A * 2/1990 Schechter et al. ..... 123/533
6,196,199 B1 3/2001 Jiang
6,227,175 B1 5/2001 Jiang et al.
6,247,450 B1 6/2001 Jiang
6,302,333 B1 10/2001 Hoffmann et al.
6,345,771 B1 2/2002 Gromek et al.
6,390,069 B1 5/2002 Jiang et al.
6,460,779 B1 10/2002 Boecking
6,684,854 B2 * 2/2004 Coldren et al. ..... 123/446
7,252,249 B2 * 8/2007 Molnar ..... 239/585.4

* cited by examiner

*Primary Examiner*—Stephen K Cronin
*Assistant Examiner*—Keith Coleman
(74) *Attorney, Agent, or Firm*—Reising Ethington P.C.

(57) ABSTRACT

A fuel injector 10 for a Diesel engine has a plunger 12 and two control valves 20 and 30 for controlling the injection of fuel from the main supply cavity to the discharge port 52. Each control valve 20 and 30 are actuated through piezo-electric stacks 34 and 74 connected to a electronic variable voltage supply 33.

8 Claims, 7 Drawing Sheets

Triple Injection

Needle Control Actuator Signal and the Needle Lift

FUEL INJECTOR WITH DUAL PIEZO-ELECTRIC ACTUATOR

TECHNICAL FIELD

The field of this invention relates generally to a fuel injector assembly for an internal combustion engine and more particularly to a fuel injector having dual piezo-electric actuators.

BACKGROUND OF THE DISCLOSURE

Fuel injector assemblies are often utilized in internal combustion engines for delivering a metered measure of fuel to the combustion chamber. The injected fuel mixes with air within the chamber for combustion. Precise metering and timing of the fuel injection provides for better combustion, thus better horsepower, fuel economy and performance. In addition precise control of the fuel injection has also been known to improve emission performance.

Piezo-electric material provides for a rapid response when a voltage is applied to the material. When piezo-electric material is incorporated in a control actuator of a Diesel fuel injector it is faster and more responsive than solenoid actuated or mechanically actuated valves. Furthermore, the rate of injection can be modulated by varying the voltage applied to the piezo-electric actuator.

Precise fuel injection is often difficult to achieve because many fuel injectors' performance is dependent on the speed and load of the engine. Secondly, many fuel injection devices rely on the pressure within a common rail which has a relatively large volume and provides a relatively constant pressure. A common rail, due to its relatively large volume, is relative slow to respond to any desired changes of pressure for sequential cycles of the fuel injector.

On the other hand, fuel injectors which use a cam or rocker arm to actuate a fuel injection piston in an individual injector have the fuel pressure and rate of injection quickly responsive to changes in conditions. However, the valve's injection rate of delivery is highly dependent on the engine speed. To eliminate the dependence on the engine speed, a fuel injector may have the opening and closing of an independent pressure control actuator controlled by a solenoid or a more responsive piezo-electric device connected to an electronic EUI controller.

One way to lower NOx emissions and meet stricter emission requirements is to regulate the rate of fuel injection and/or multiple injections such as a controlled pilot injection followed by a main injection. Previous injectors allow a pilot injection but only at the expense of the initial pressure and the fuel injection rate and quantity of the main injection. In addition, the injection rate with respect to time is naturally sloped having a relatively linear build-up from a low initial rate to a high rate near the end of injection. Attempts have been made to contour the injection rates by using injector cams with high velocity profiles but these specialized cams may provide only limited effect due to mechanical design constraints. It has also been proposed to provide a post injection after main injection, to reduce particulate emissions.

What is needed is a fuel injector that provides highly controlled fuel injection rates independent of engine speed and also responsive enough to provide a pilot injection phase and a post injection phase without degradation of the main injection phase.

SUMMARY OF THE DISCLOSURE

In accordance with one aspect of the invention, a fuel injection assembly includes an injection body with a fuel supply passage and a main high pressure fuel supply cavity. A plunger is disposed within the injector body for displacing fuel from the fuel supply cavity. The supply cavity has a first outlet passage leading from said cavity and in selective fluid communication with a low pressure return. A normally open first actuator valve is in the first outlet to open or close a connection of the first outlet to the low pressure return. Preferably, the first actuator valve has a piezo-electric stack and a hydraulic amplifier for elongating the stroke of the control valve with respect to the amount of elongation of the piezo-electric stack. Preferably, the first piezo-electric stack is mounted adjacent the main high pressure fuel supply cavity.

A second passage leads from the main high pressure supply cavity to an injector nozzle valve. The nozzle valve injects fuel into a combustion chamber of an internal combustion engine. The nozzle valve is constructed to be opened by fluid pressure exerted from the second passage onto the nozzle valve in the opening direction. A restrictive passage leads from the second passage to a chamber at the backside of the nozzle valve for exerting opposing fluid pressure on the nozzle valve to close the nozzle valve against the opening fluid pressure exerted on the nozzle valve. A third passage leads from the chamber to the low pressure return. A normally closed second actuator valve is constructed to open or close fluid communication between the chamber and the low pressure return via the third passage.

Preferably the second actuating valve is opened and closed by a second piezo-electric stack mounted closely above the needle nozzle valve and desirably coaxially along the longitudinal central axis of said injection body. The piezo-electric stack when incorporated into an actuating valve can be referred to as a piezo-electric actuator.

In one embodiment, the restrictive passage leading to the chamber is more restrictive than the third passage. This restriction prevents pressure build up in the chamber when the second control valve is open, i.e., any pressure leading through the restriction is immediately relieved by the chamber and third passage opening to the low pressure return. In one embodiment, the piezo-electric stacks are controlled by a variable voltage source.

According to another aspect of the invention, a method of fuel injection into an internal combustion engine includes providing a fuel injector body with a main supply cavity and controlling fluid communication of the supply cavity to a low pressure spill port by a first pressure control valve and controlling fluid communication of the main supply cavity through a nozzle valve to the combustion chamber with a second control valve. Pressure within the main supply cavity, preferably by a moving plunger, is built up when the first pressure control valve is closed. Opening of the second control valve after the pressure is built up within the main supply cavity causes the nozzle valve to open to the combustion chamber to provide fuel injection.

Desirably, a pressure chamber on a backside of the nozzle valve is pressurized to close the nozzle valve when both of the first and second control valves are closed. Upon opening of the second control valve, the chamber pressure is lowered to open the nozzle valve to the combustion chamber and providing injection of fuel from the main supply cavity from within the fuel injector. It is desirable to apply a voltage to first and second piezo-electric stacks in the first and second control valves for controlling the respective fluid communication of the supply cavity and second control valve to the low pressure return. It is further desirable to apply controlled and variable voltage or charge to the piezo-electric stacks to control and modulate the sealing force and degree of opening of the control valve in order to affect injection rate shaping.

In this fashion, a fuel injection device for an internal combustion engine such as a Diesel engine can with precision, control pressure and initial fuel injection rates and can provide for pilot injection, main injection and post injection by using two piezo-electric actuators for each injector. Such precise control of injection rates provides better control between sequential cycles and reduced transient emissions.

BRIEF DESCRIPTION OF THE DRAWINGS

Reference now is made to the accompanying drawings in which.

DETAILED DESCRIPTION OF THE PREFERRED EMBODIMENT

Figure 1:
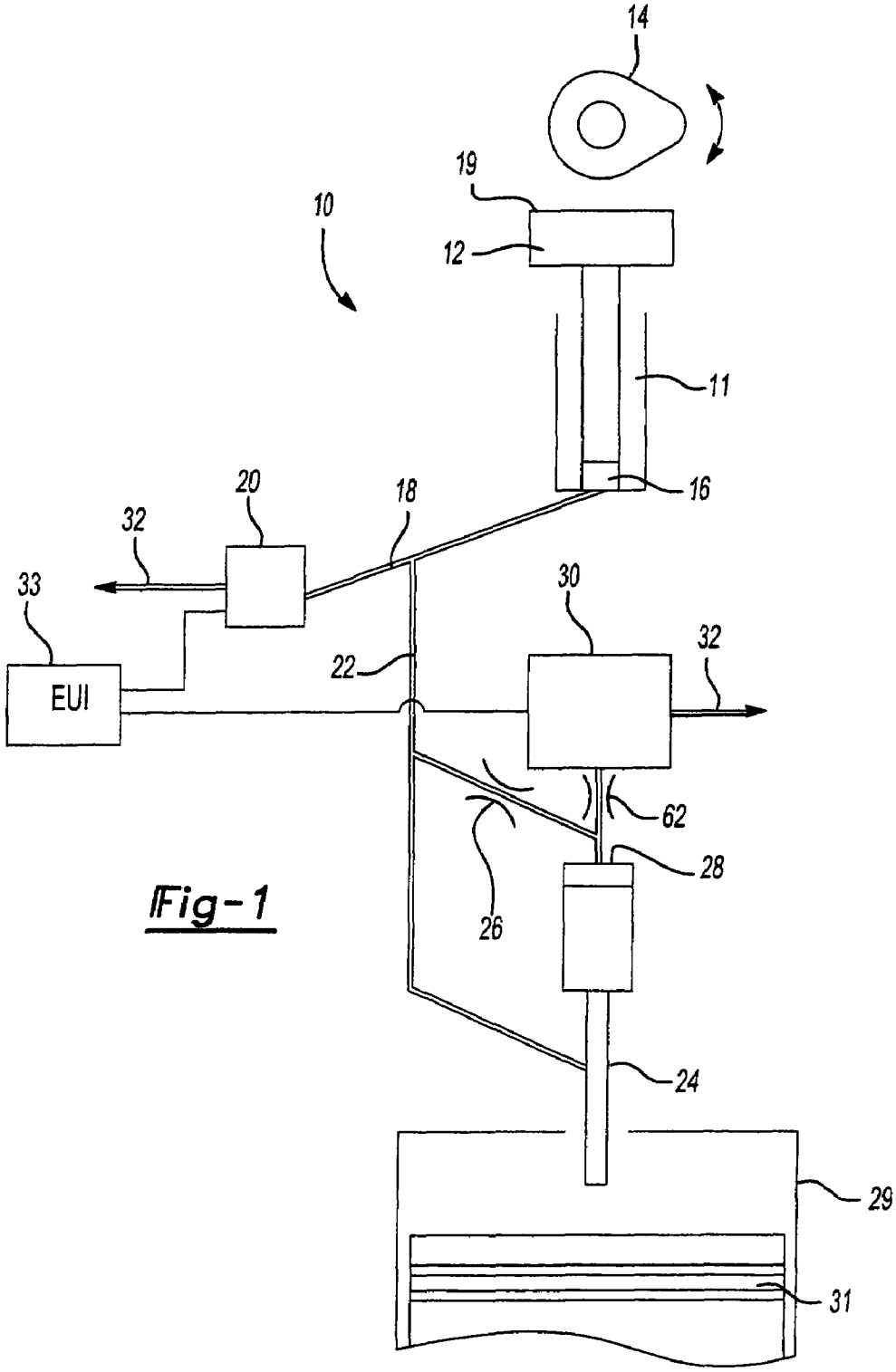
FIG. 1 is a diagrammatic representation of an embodiment in accordance with the present invention.

Referring now to FIG. 1, a hydraulic schematic shows an injector device 10 having a main body 11 with a sliding plunger 12 operated by a cam or rocker arm 14 of an internal combustion engine such as of a diesel engine. The plunger causes a displacement of fluid in cavity 16 and conduit 18 leading to a control actuator 20 and a second passage 22 which leads to a nozzle valve 24 which is operably mounted to a combustion chamber 29 that receives piston 31 in the Diesel engine. A restrictive passage 26 in communication with passage 22 leads to a chamber 28 on the back side of nozzle valve 24. A second control actuator 30 is in communication with chamber 28.

The first control actuator 20 selectively opens or closes communication of passages 18 and 22 to a low pressure spill way 32. Similarly, second control valve 30 selectively communicates chamber 28 to low pressure spill way 32. Each control valve 20 and 30 is operably connected to an electronic control unit (EUI) 33 capable of providing variable voltage supply.

Figure 2:
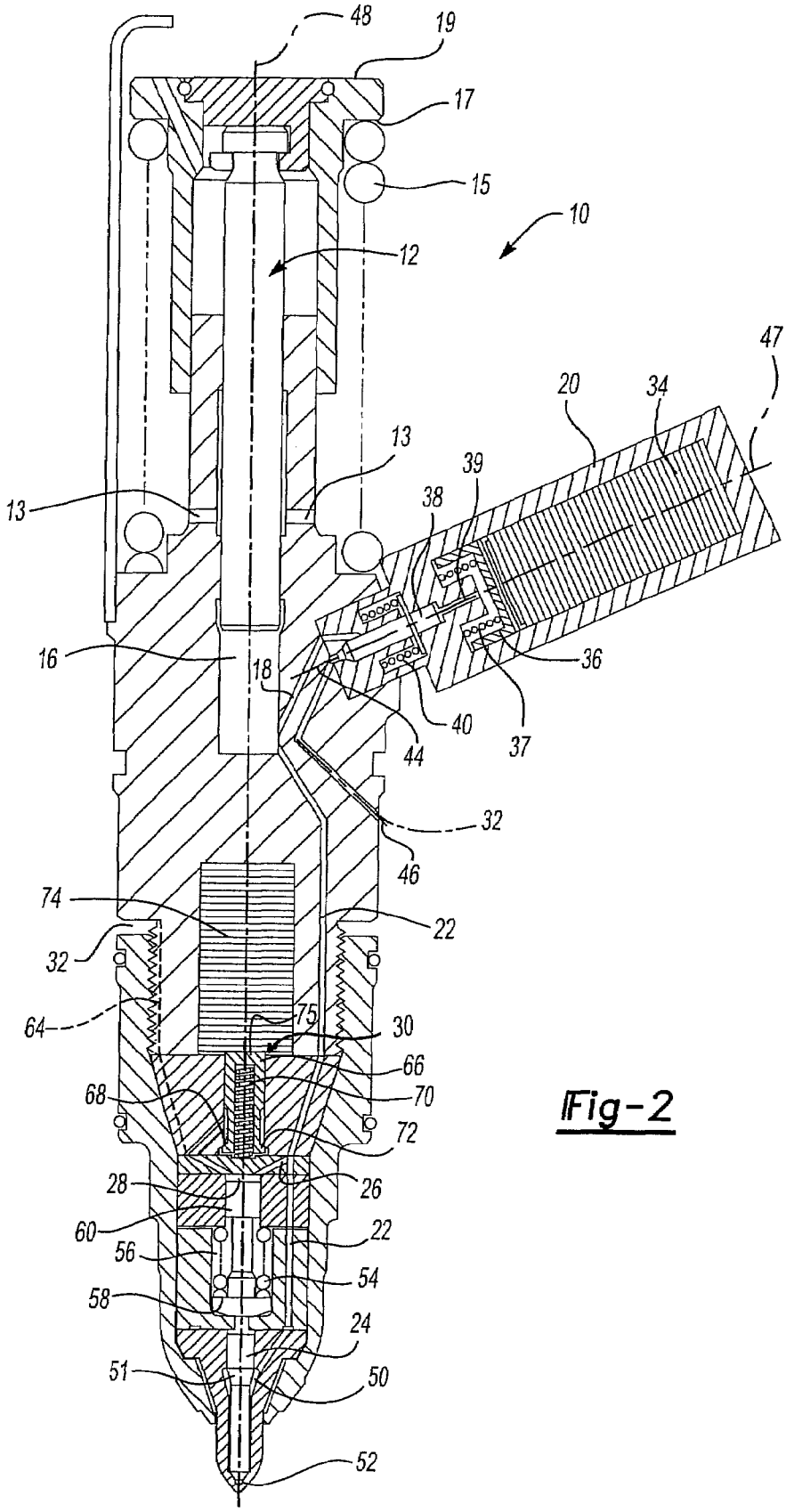
FIG. 2 is a cross-sectional side view of a fuel injector assembly that is diagrammatically shown in FIG. 1 with the valve shown in the closed position.
Figure 3:
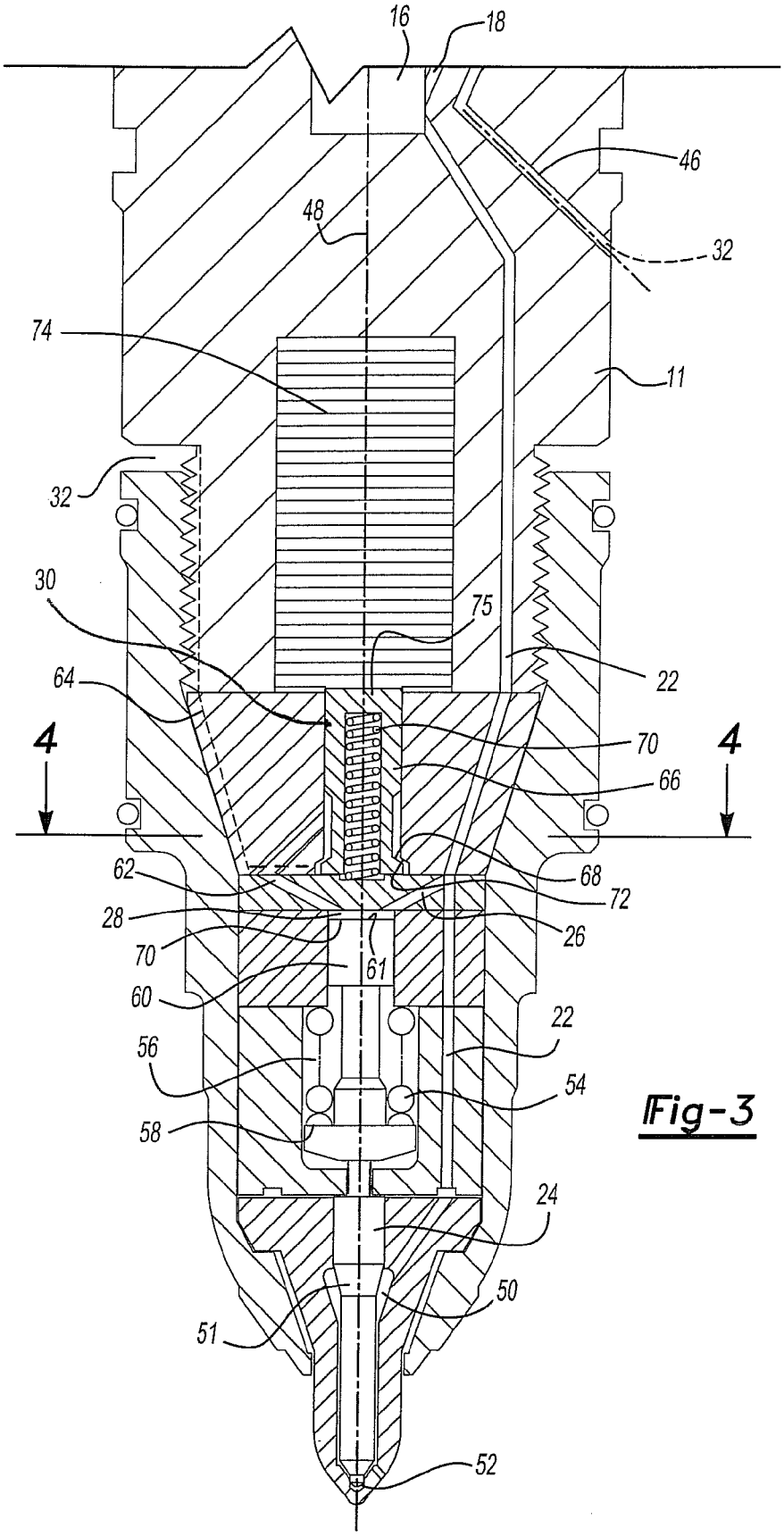
FIG. 3 is an enlarge fragmentary view of the bottom portion of the injector 10 showing the second control valve and nozzle valve both in the open position.
Figure 4:
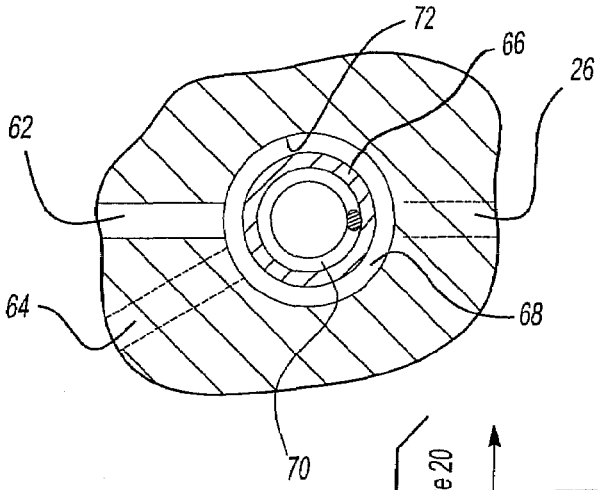
FIG. 4 is an enlarged cross sectional view taken along lines 4-4 as shown in FIG. 3.

Referring now to FIGS. 2 and 3, an example of such an injector assembly 10 is shown. The injector 10 has plunger 12 slidably mounted in main supply cavity 16 in main body 11 which is in communication with a fuel supply passage 13 which can be mounted to a fuel supply line (not shown). The plunger 12 is spring biased upwardly by coil spring 15 which engages a flange 17 at the top end 19 of the plunger. The rocker arm or cam 14 schematically shown in FIG. 1 conventionally engages the top 19 of plunger 12 to operably move it against the bias of spring 15.

The main supply cavity 16 is fluidly connected to a first passage 18 which leads to control valve 20. Control valve 20 has a piezo-electric stack 34 which slidably moves a spring biased valve piston 36 by coil spring 37. The piston 36 is hydraulically linked to a smaller area valve piston 38 through linking passage 39. The fluid chamber under piston 36 can be either hermetically sealed or re-supplied from spill passage 46 via a check valve, with appropriate de-aeration mechanism. Valve piston 38 is also spring biased upward to the open position by coil spring 40. The area of piston 36 is five to twenty times the size of area of piston 38 to provide hydraulic amplification to piston 38 which sufficiently amplifies longitudinal movement for opening and closing with respect to port 44 that opens or closes passage 18 to spill passage 46. Spill passage 46 leads to the low passage spillway 32. The spring bias provides that the valve port 44 is normally open when the piezo-electric stack 34 is not actuated. Valve port 44 is closed when the piezo-electric stack 34 is actuated. The piezo-electric stack 34 is generally aligned along the longitudinal axis 47 of the first control valve 20 which in turn is mounted onto body 11.

The second passage 22 extends from the main supply cavity 16 down to nozzle valve annular chamber 50 about tapered needle nozzle valve 24. The pressure in chamber 50 by acting on tapered section 51 of needle nozzle valve 24 normally provides an opening force on the nozzle valve 24 to exit through discharge port 52 into the combustion chamber shown in FIG. 1. The needle nozzle valve 24 is normally biased to close discharge port 52 by coil spring 54 mounted in spring cavity 56 and pushing on flange 58 when the opening pressure is absent from chamber 50.

In addition a control piston 60 is coaxially mounted through coil spring 54 to also engage the needle nozzle valve 24. As shown in FIG. 3, the piston 60 has its upper surface 61 facing chamber 28 which is in communication with passage 22 through restrictive passage 26. The chamber 28 is in effect on the back side of nozzle 24 such that when the same pressure is in both chambers 28 and 50, the closing/acting force on the top 61 of the hydraulic piston is much higher than the net force of the closing force due to spring 54 and opening force due to pressure in chamber 50 to maintain the nozzle 24 in the closed position as shown in FIG. 2. The control valve 30 has a valve member 66 with an annular shoulder valve section 68 that is normally biased by coil spring 70 to a closed position against annular valve seat 72 in the body 11.

Chamber 28 is normally at the same pressure as chamber 50. Both chamber 28 and 50 are in constant communication to the same passage 22. The second control valve 30 when unactuated is normally closed to shut an exit orifice 62 leading from chamber 28 to a low pressure outlet 64 that leads back to spill way 32.

A piezo-electric stack 74 mounted along the longitudinal axis 48 of the injector body 11 abuts the upper end 75 of valve member 66. When the piezo-electric stack 74 is actuated via controller 33, it moves valve 66 to an open position as shown in FIG. 3. When the valve member 66 is moved downward and shoulder section 68 disengages from annular valve seat 72, the chamber 28 opens up to low pressure outlet 64 and low pressure spill port 32. The open passage formed by outlet orifice 62, formed opening between the annular shoulder 68 and valve seat 72, and low pressure outlet 64 has less restriction than restrictive inlet passage 26 to chamber 28. Thus, when control valve 30 is actuated, the chamber 28 has its pressure lowered and remains low due to the restriction in passage 26. Pressure within chamber 28 is immediately relieved by the less restrictive communication to low pressure spill way 32. The pressure in chamber 50 then opens the needle nozzle valve 23.

When the piezo-electric stack 74 is deactuated the valve 66 moves to the closed position due to the closing bias of spring 70. Pressure in chamber 28 then is increased to line pressure in passage 22. Needle nozzle valve 24 then closes.

The volume in chamber 28 and exit orifice 62 are small which provides very little delay in the pressure discharge when chamber 28 is opened to spill way 32. Similarly, when the control valve 30 closes, the small size of chamber 28 and exit orifice 62 provide very little delay to become pressurized through the restrictive passage 26.

Figure 5:
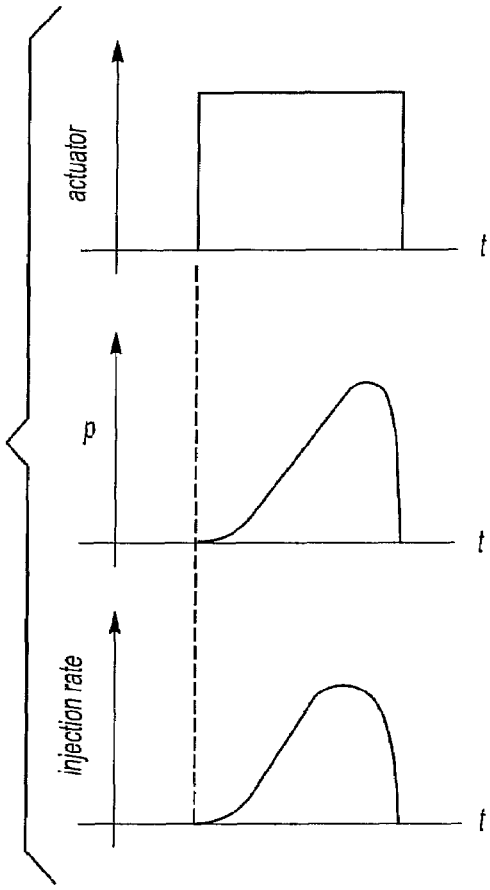
Fig-5 PRIOR ART
FIG. 5 is a typical graph of the control valve actuation, pressure and injection rate versus time in accordance with a typical prior art injection valve with a single actuator valve.

The first and second control valves 20 and 30 are timed such that they together provide a superior discharge profile through nozzle discharge port 52. A typical graph profile shown in FIG. 5 for actuation, pressure and injection rate is illustrated for a conventional injector with a single actuator. The control valve closes relatively instantly as shown by the rear vertical left leg of the actuation portion of the graph. However, the fluid pressure starts to build up from substantially a nil pressure level, and builds to a peak along a slope as shown in the middle graph. The injection rate as illustrated in the bottom graph thus follows the contour of the pressure profile but slightly delayed resulting in a relatively low initial rate which builds along a relatively gentle slope.

Figure 6:
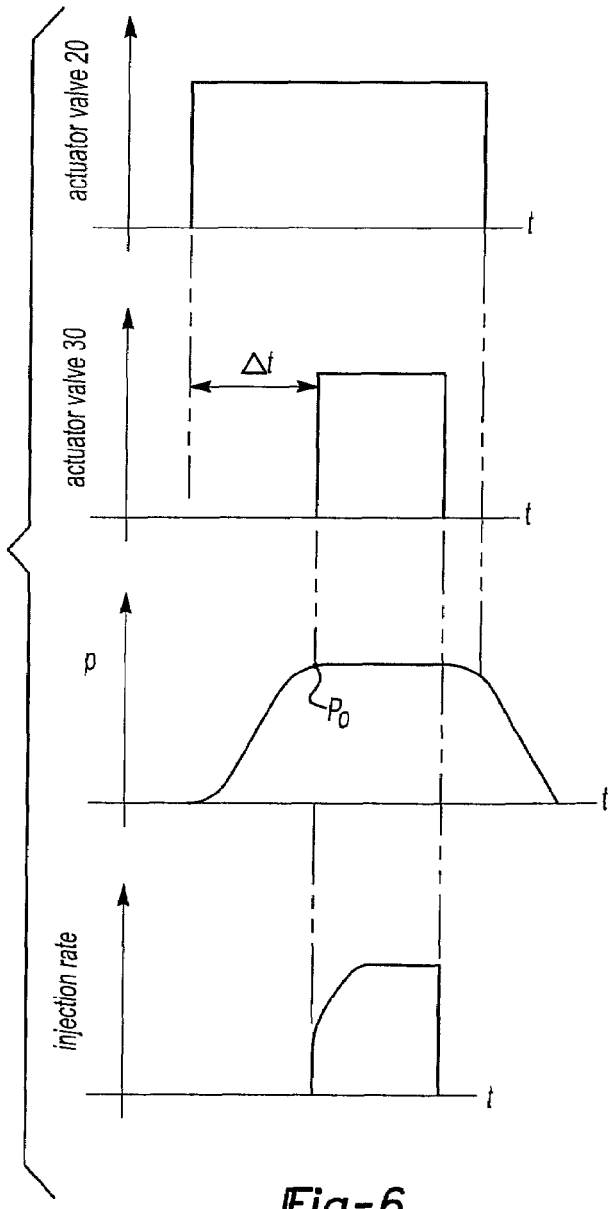
FIG. 6 is a schematic graph of the first control actuator valve actuation, second actuator valve delayed actuation, pressure and injection rate versus time achievable by the invention shown in FIGS. 1-4.

On the other hand, with the present invention, the pressure control valve 20 can be actuated a predetermined time before the second control valve 30 is actuated and opening the nozzle valve. As such the pressure builds up to point $P_o$ at which time the second control valve is actuated. After a predetermined lapse of time $\Delta t$, the second control valve 30 is the actuated to commence the injection. The resulting injection rate undergoes a fast initial build up as shown in the last graph in FIG. 6 such that the injector rate quickly reaches a plateau based on the relatively high pressure $P_o$ at the time the valve opens.

Figure 7:
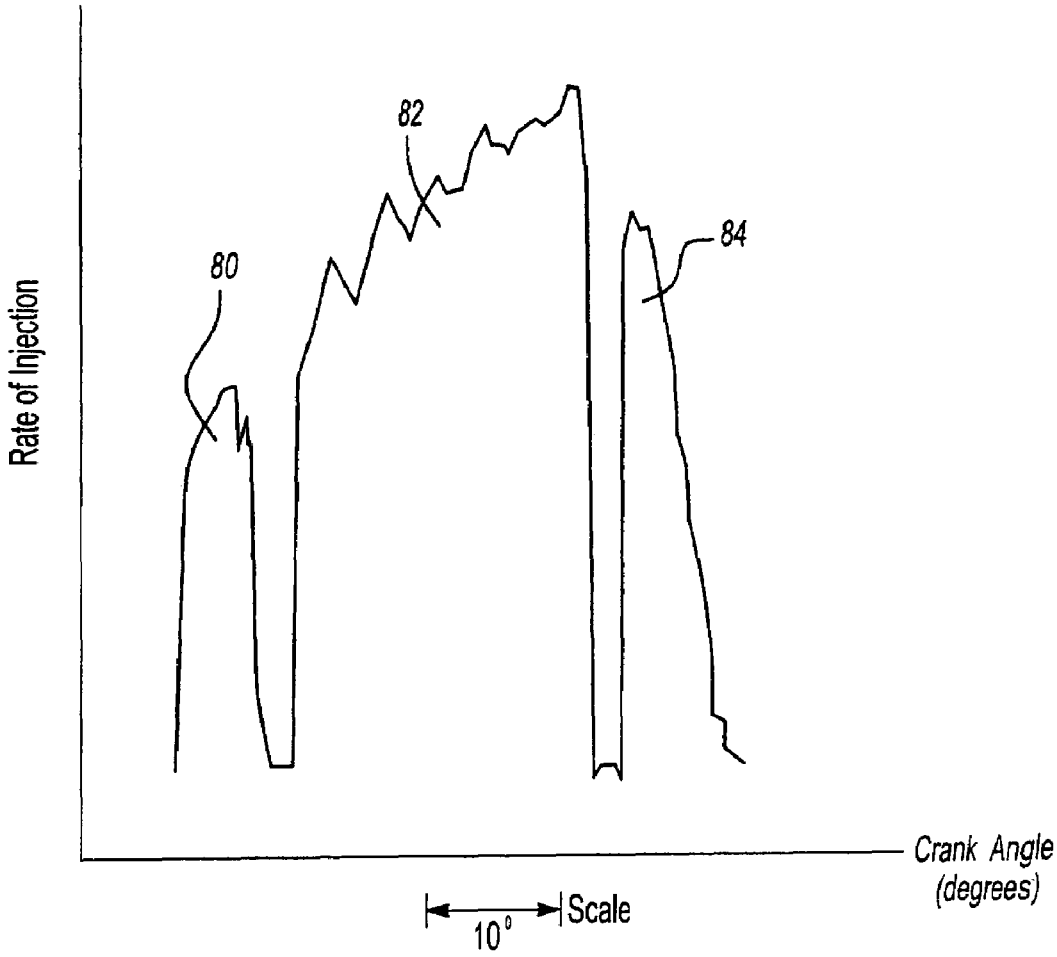
FIG. 7 is a graph illustrating injection rate over crank angle providing a triple injection per cycle achievable with the present invention.
Figure 8:
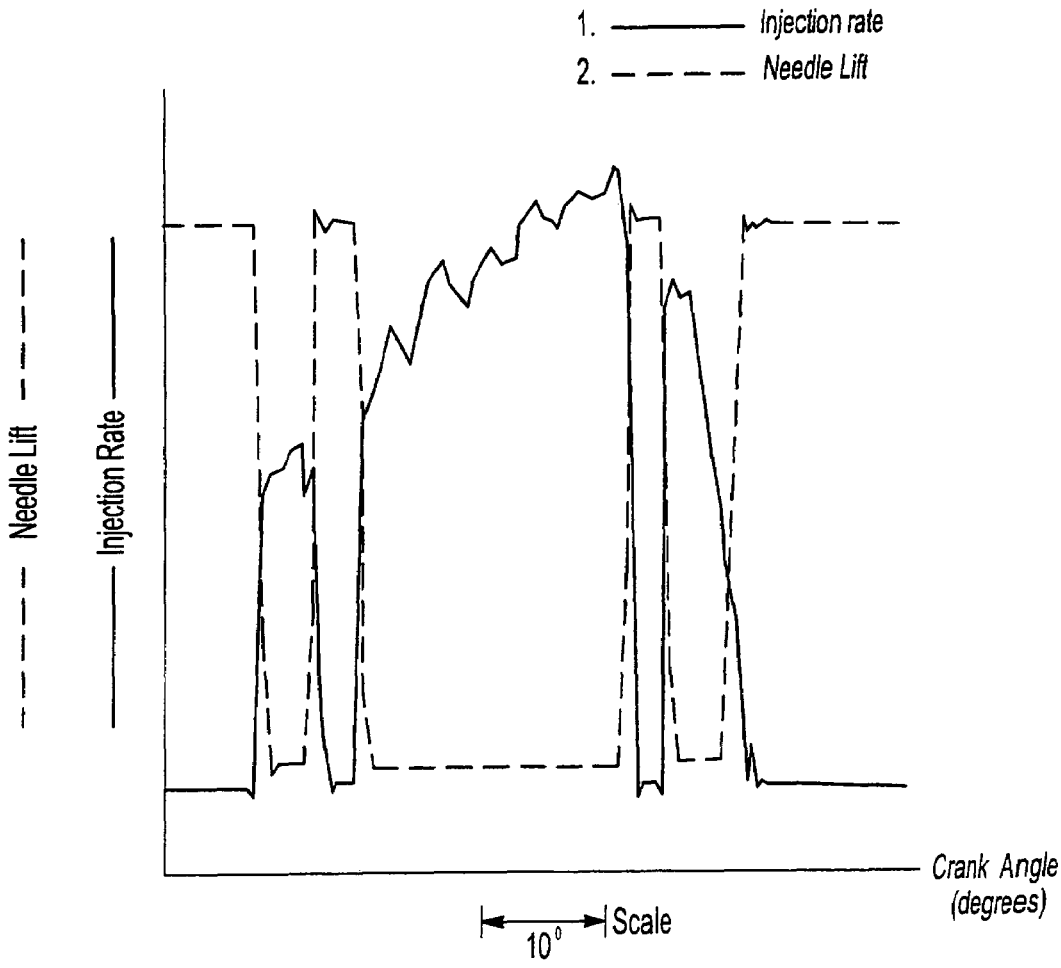
FIG. 8 is a graph illustrating injection rate and needle lift versus crank angle during the triple injection shown in FIG. 7 achievable by the present invention.

Hydraulic simulations have obtained results as shown in FIG. 7 where a triple injection phase of a fuel during a single cycle run at 1800 rpm. As one can readily see, the initial slopes of the injection rate during any of the pilot phase 80, main injection phase 82 or post injection phase 84 can have sharp initial slopes and also quick shut offs during very short crank angle changes. As shown in FIG. 8, the injection rate is now overlaid with the inverted needle lift profile and one can see the quick action of the needle lift and how the high pressure at the initial injection provided by the preclosing of the first control valve provides for quick response and fast injection simultaneously with the needle lift.

Figure 9:
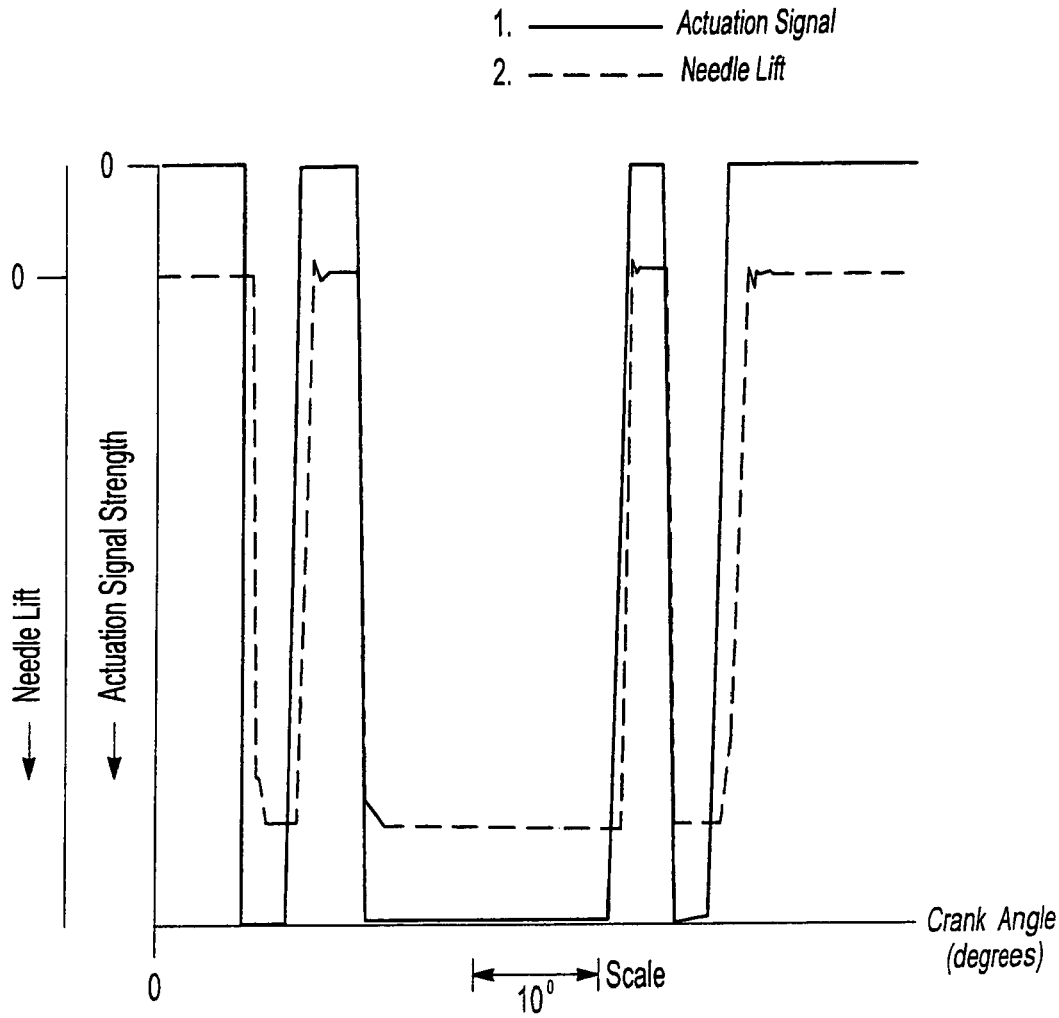
FIG. 9 is a graph illustrating the needle control actuator signal from the electronic controller and the needle lift versus the crank angle during the triple injection shown in FIG. 7.

The use of a piezo-electric actuator provides for a responsive valve. FIG. 9 overlays the needle control actuator signal from the electronic controller and the needle lift through the actuation of the piezo-electric actuator. The quick response time due to the small volume of chamber 28 and its controlled release of pressure provides for only a very slight delay for the needle lift after the actuation signal is initially sent. The speed of release can be further controlled by modulation of piezo actuation voltage or charge.

The injection body 11 may optionally be provided with a waste gate safety valve connected to passage 22 to assure that pressure in the supply cavity or passageway 22 never exceeds a predetermined maximum. The optional wastegate valve opens to the spill way 32 when the pressure in the passageway 22 exceeds a predetermined maximum pressure and closes again when the pressure drops below the predetermined maximum pressure. However, it is believed that precise control can be achieved with the two control valves 20 and 30 in a reliable fashion to control the pressure within the supply cavity 16 and passage 22 without the need for a wastegate valve.

In this fashion, one can provide for a quick response injector with a controlled initial injection rate. The injector can be electronically modified with each cycle without large hydraulic delays due to a common rail pressure or large hydraulic delays within the injector body.

Two control valves are both actuated through piezo-electric stacks which are quickly responsive to electronic voltage supply signal and can be modulated in its actuation mode through variable or modulated voltage through the supply 33. The two piezo-electric stacks are canted with respect to each other for easy packaging within the engine.

Dual and triple injection cycles are possible without degradation of the injection rate of the main phase of the injection. Injection rates are also independent of the RPM or torque load of the engine. The injection device is also quickly responsive to help reduce transient emissions during change of speed, torque or other parameters of the engine. The responsiveness is quick enough to adjust between sequential injection cycles of the injector 10. The piezo-electric stacks may be modulated through a variable voltage to provide more control of the control valves 20 and 30.

Other variations and modifications are possible without departing from the scope and spirit of the present invention as defined by the appended claims.

The embodiments in which an exclusive property or privilege is claimed are defined as follows:

1. A fuel injection assembly comprising:

an injection body with a fuel supply passage and a main high pressure fuel supply cavity;

a plunger disposed within said injector body for displacing fuel from said fuel supply cavity;

a first outlet passage leading from said cavity and in selective fluid communication to a low pressure return;

a first actuator valve in said first outlet passage to control the fluid communication of said first outlet passage to said low pressure return;

a second passage leading from said cavity to a nozzle valve, which opens to allow fuel to be injected therefrom;

said nozzle valve constructed to be opened by fluid pressure exerted in said second passage onto said nozzle valve;

a continuously open restrictive passage continuously open from said second passage to a chamber at the backside of said nozzle valve for exerting closing fluid pressure from said second passage onto said nozzle valve to close said nozzle valve against the opening fluid pressure exerted on said nozzle valve;

a third passage leading from said chamber to said lower pressure return;

said third passage being less restrictive than said continuously open restrictive passageway when said actuator valve is in an open position; and a second actuator valve to control fluid communication between said chamber and said low pressure return via said third passage to relieve pressure from said chamber and to prevent closing fluid pressure from building up in said chamber when said second acturation valve is actuated to open communication between said continuously open restrictive passageway and said third passage via the chamber and said low pressure return.

2. A fuel injection assembly as defined in claim 1 further comprising:

said first and second actuating valves being opened and closed by respective first and second piezo-electric actuators.

3. A fuel injection assembly as defined in claim 2 further comprising:

said first piezo-electric actuator including a first piezo-electric stack mounted adjacent to said main high pressure fuel supply cavity; and said second piezo-electric actuator including a second piezo-electric stack mounted closely above the needle nozzle valve.

4. A fuel injection assembly as defined in claim 3 further comprising:

said first piezo-electric actuator having a hydraulic amplifier for amplifying the stroke of the control valve from the amount of length that the first piezo-electric stack elongates during excitation.

5. A fuel injection assembly as defined in claim 1 further comprising:

said piezo-electric stacks being controlled by a variable voltage source.

6. A method of injecting fuel into a combustion chamber of an internal combustion engine comprising;

providing a fuel injector body with a main supply cavity in fluid communication to a nozzle valve;

controlling fluid communication of said cavity to a low pressure spill port through a first pressure control valve;

controlling fluid communication of said main supply cavity through a nozzle valve to the combustion chamber with a second control valve;

pressurizing the fluid within said main supply cavity;

closing said first pressure control valve such that main supply cavity is closed to allow pressure to build up within said main supply cavity;

providing a continuously open restrictive passage in fluid communication from said main supply cavity to a pressure chamber at the backside of said nozzle valve for exerting closing fluid pressure from said main supply cavity onto said nozzle valve;

providing a third passage that is less restrictive than said restrictive passage leading from said chamber to a low pressure return; and opening said second control valve after the closing of said first control valve and after the pressure is built up with said main supply cavity leading to said nozzle valve to provide fluid communication from said continuously open restrictive passage through said pressure chamber through said third passage and to said low pressure return and for releasing the pressure in the chamber through said third passage for opening said nozzle valve to said combustion chamber.

7. A method as defined in claim 6 further comprising:

applying a voltage to a first piezo-electric stack in said first pressure control valve for controlling said fluid communication to said low pressure spill port; and applying a voltage to a second piezo-electric stack in said second control valve for controlling said fluid communication of a nozzle valve to said combustion chamber.

8. A method as defined in claim 7, further comprising: applying controlled and variable voltage charge to said piezo-electric stacks to control and modulate the sealing force and degree of opening of the control valve in order to affect injection rate shaping.

* * * * *